US006931218B2

(12) United States Patent
Kakeshita et al.

(10) Patent No.: US 6,931,218 B2
(45) Date of Patent: Aug. 16, 2005

(54) IMAGE FORMING APPARATUS AND CONTROL METHOD THEREFOR, PROCESS CARTRIDGE AND MEMORY DEVICE

(75) Inventors: Tomomi Kakeshita, Tokyo (JP); Masanobu Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 10/626,745

(22) Filed: Jul. 25, 2003

(65) Prior Publication Data

US 2004/0208657 A1 Oct. 21, 2004

(30) Foreign Application Priority Data

Jul. 25, 2002 (JP) ..... 2002-216940
Jul. 18, 2003 (JP) ..... 2003-199361

(51) Int. Cl.[7] ..... G03G 15/08
(52) U.S. Cl. ..... 399/27; 399/29
(58) Field of Search ..... 399/25, 27–30, 399/111, 112, 223

(56) References Cited

U.S. PATENT DOCUMENTS 5,475,472 A 12/1995 Saito et al. ..... 355/219
5,669,042 A 9/1997 Kobayashi et al. ..... 399/111
6,275,664 B1 * 8/2001 Wolf et al. ..... 399/27
6,591,070 B1 7/2003 Shoji et al. ..... 399/27
6,594,451 B2 7/2003 Kakeshita et al. ..... 399/24
6,597,876 B1 7/2003 Sakurai et al. ..... 399/25
6,687,467 B2 * 2/2004 Katoh ..... 399/30
2002/0025176 A1 2/2002 Sakurai et al. ..... 399/25
2003/0044198 A1 3/2003 Kato et al. ..... 399/109
2003/0147669 A1 8/2003 Kakeshita et al. ..... 399/149
2003/0152395 A1 * 8/2003 Kurihara ..... 399/27
2003/0228162 A1 * 12/2003 Hattori ..... 399/27
2003/0228164 A1 * 12/2003 Katoh ..... 399/30
2004/0075855 A1 * 4/2004 Tyson et al. ..... 399/30
2004/0080774 A1 * 4/2004 Owen et al. ..... 399/27
2004/0081477 A1 * 4/2004 Maebashi et al. ..... 399/49
2004/0184829 A1 * 9/2004 Shin et al. ..... 399/57
2004/0202485 A1 * 10/2004 Uyama ..... 399/27
2004/0208657 A1 * 10/2004 Kakeshita et al. ..... 399/27
2005/0047804 A1 * 3/2005 Kosuge ..... 399/27

* cited by examiner

*Primary Examiner*—G. Bradley Bennett
(74) *Attorney, Agent, or Firm*—Fitzpatrick, Cella, Harper & Scinto

(57) ABSTRACT

An image forming apparatus (typically a color printer) and control method use a detachable yellow toner process cartridge Y for forming a yellow toner image on a recording medium and a detachable magenta process cartridge M for forming a magenta toner image on the recording medium after the yellow image has been formed. By detecting the amount of toner user by the yellow process cartridge Y and estimating the amount of yellow toner that has gotten into the magenta process cartridge M, the apparatus and method can determine when the useful life span of the magenta process cartridge M is at an end. By displaying a message to a user that it is time to replace the magenta process cartridge M before print picture quality deteriorates, the apparatus and method make it possible to avoid outputting poor quality printed images.

17 Claims, 5 Drawing Sheets

FIG. 5

TABLE SHOWING RELATION BETWEEN INDIVIDUAL COLOR TONER USE AMOUNTS AND OFF-COLOR RECOVERED TONER AMOUNTS

| | Y | M | C | K |
|---|---|---|---|---|
| NUMBER OF PRINTED PAGES | 4000 | 3200 | 3040 | 4552 |
| TONER USE AMOUNT (g) | 100 | 80 | 74 | 113.8 |
| MIXED-IN TONER AMOUNT (g) | 0 | 5 | 4 | 3.8 |
| AMOUNT OF TONER REMAINING (g) | 30 | 55 | 60 | 20 |

TABLE SHOWING RELATION BETWEEN DEVELOPER ROLLER ROTATION SPEEDS AND INVERTED TONER AMOUNTS

| | Y | M | C | K |
|---|---|---|---|---|
| DEVELOPER ROLLER ROTATION SPEED (rpm) | 70000 | 58000 | 70000 | 50000 |
| DEGRADED TONER AMOUNT (g) | 5.36 | 9.26 | 12.7 | 1.8 |

IMAGE FORMING APPARATUS AND CONTROL METHOD THEREFOR, PROCESS CARTRIDGE AND MEMORY DEVICE

CLAIM OF PRIORITY

The present application claims priority from Japanese Patent Application No. 2002-216940 filed on Jul. 25, 2002 and Japanese Patent Application No. 2003-199361 filed on Jul. 18, 2003, the contents of which are hereby incorporated by reference.

FIELD OF THE INVENTION

This invention relates to an image forming apparatus and control method therefore, process cartridge and memory device, and more particularly, to an image forming apparatus using electrophotography, a detachable process cartridge that can be freely attached to and detached from the image forming apparatus, and a control unit for the image forming apparatus.

BACKGROUND OF THE INVENTION

As office automation has advanced and office equipment become more sophisticated, the use of color imaging has grown accordingly. In particular, electrophotographic image forming apparatuses such as copiers and laser printers have become ubiquitous. One type of such electrophotography equipment known generally as a cleaner-less image forming apparatus has been proposed, which eliminates the usual cleaning means that typically consists of a cleaning blade for cleaning toner from an image carrier of the image forming apparatus. The advantage of such an arrangement is that it does away with the need for such maintenance work as disposing of any residual transfer toner. With image forming apparatuses of this type, any residual toner remaining in the unexposed portions of the image carrier is returned to the toner container inside the developer unit by electrostatic action, that is, by the difference between the electric potential of the surface of the image carrier and the development bias imparted to the developer roller. In addition, elimination of the blade or other such cleaning means makes it possible to make the image forming apparatus itself more compact and easier to produce.

However, picture quality deteriorates whenever this sort of cleaner-less process is applied to multiple full-color electrophotography systems, for the following reason:

In the case of a full-color printer, the color image is printed onto the recording paper atop the transfer belt and the transfer roller that together make up a single transfer member by contacting the recording paper with successive photoreceptors of different colors, so that the final printed product represents successive overlapping (that is, overlaid) color toner images. But in so doing, toner transferred from the upstream photoreceptors adheres first to the recording paper and from the recording paper to the downstream photoreceptors. For example, in an arrangement in which image formation is performed in the order of yellow (Y), magenta (M), cyan (C) and black (BK), yellow toner transferred upstream can adhere to the downstream magenta toner photoreceptor, the cyan toner photoreceptor and the black toner photoreceptor.

With the cleaner-less process, the off-color toner, that is unusual toner, that adheres to the downstream photoreceptor is then returned to the toner container, thus changing the color of the toner contained in the toner container due to this inclusion of off-color toner, which then changes the coloration of the toner transferred to the recording paper and thereby degrading the resulting picture quality.

Also, apart from the off-color toner, the toner contained in the toner container inside the redevelopment unit contains a large amount of degraded toner (that is, defective toner), which is toner that has not received a sufficient electrical charge during electrostatic charging. For example, as image formation continues and the amount of toner inside the toner container decreases and becomes small, the amount of degraded toner remaining in the toner container becomes large. Since this degraded toner has only a weak charge, it is hard to hold at the developer roller, causing the amount of coating on the developer roller to become uneven. This unevenness in the coat roller can in turn cause the degraded toner to harden into lumps which, when developed, form blotches on the image.

SUMMARY OF THE INVENTION

Accordingly, the present invention is conceived as a response to the above-described disadvantages of the conventional art.

According to one aspect of the present invention, preferably, an image forming apparatus comprises:

a detachable first process cartridge for forming a first color toner image on a recording medium;

a detachable second process cartridge for forming a second color toner image on the recording medium after the formation of the first color toner image on the recording medium;

first detection means for detecting an amount of toner used by the first process cartridge during color image formation; and determination means for estimating an amount of first color toner mixed into the second process cartridge based on the amount of toner detected by the detection means and determining when it is time to replace the second process cartridge based on the estimated amount of first color toner mixed into the second process cartridge.

According to another aspect of the present invention, preferably, a control method for controlling an image forming apparatus having a detachable first process cartridge for forming a first color toner image on a recording medium and a detachable second process cartridge for forming a second color toner image on the recording medium after the formation of the first color toner image on the recording medium comprises:

a detection step of detecting an amount of toner used by the first process cartridge during color image formation; and a determining step of estimating an amount of first color toner mixed into the second process cartridge based on the amount of toner detected in the detection step and determining when it is time to replace the second process cartridge based on the estimated amount of first color toner mixed into the second process cartridge.

According to still another aspect of the present invention, preferably, a cartridge that can be detachably attached to a color image forming apparatus that forms an image using a plurality of color toners, comprises:

a toner container for holding toner; and a storage unit for storing information relating to an amount of off-color toner included in said toner container.

According to still another and further aspect of the present invention, preferably, the present invention relates to a memory device loaded into a cartridge used in an image forming apparatus that uses a plurality of color toners to form an image, the image forming apparatus including an image carrier, a toner container holding toner, and a developer member for developing the toner in the toner container onto the image carrier, memory device comprising a storage area for storing information related to an amount of off-color toner in the toner container.

Other objects, features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention, in which:

FIG. 5 shows a relational table relating the toner consumption amount and the toner amount and a relation table showing the number of developer roller rotations and the amount of degraded toner.

DETAILED DESCRIPTION OF THE PREFERRED EMBODIMENTS

Preferred embodiments of the present invention will be described in detail, with reference to the accompanying drawings. It should be noted that the relative arrangement of the components, the numerical expressions and numerical values set forth in these embodiments do not limit the scope of the present invention unless it is specifically stated otherwise.

As an embodiment of the image forming apparatus according to the present invention, the example is used of a full-color laser printer that receives image data from a host computer and outputs a corresponding color image. With such a printer, the process cartridge, which has consumables such as a photosensitive drum, a static electric roller, a developer roller and toner, can be attachably detached therefrom.

However, the process cartridge according to the present invention is not limited to the arrangement described below, provided that such cartridge is at least a cartridge that integrates a developer means with a toner container and can be detachably attached to the image forming apparatus.

Figure 1:
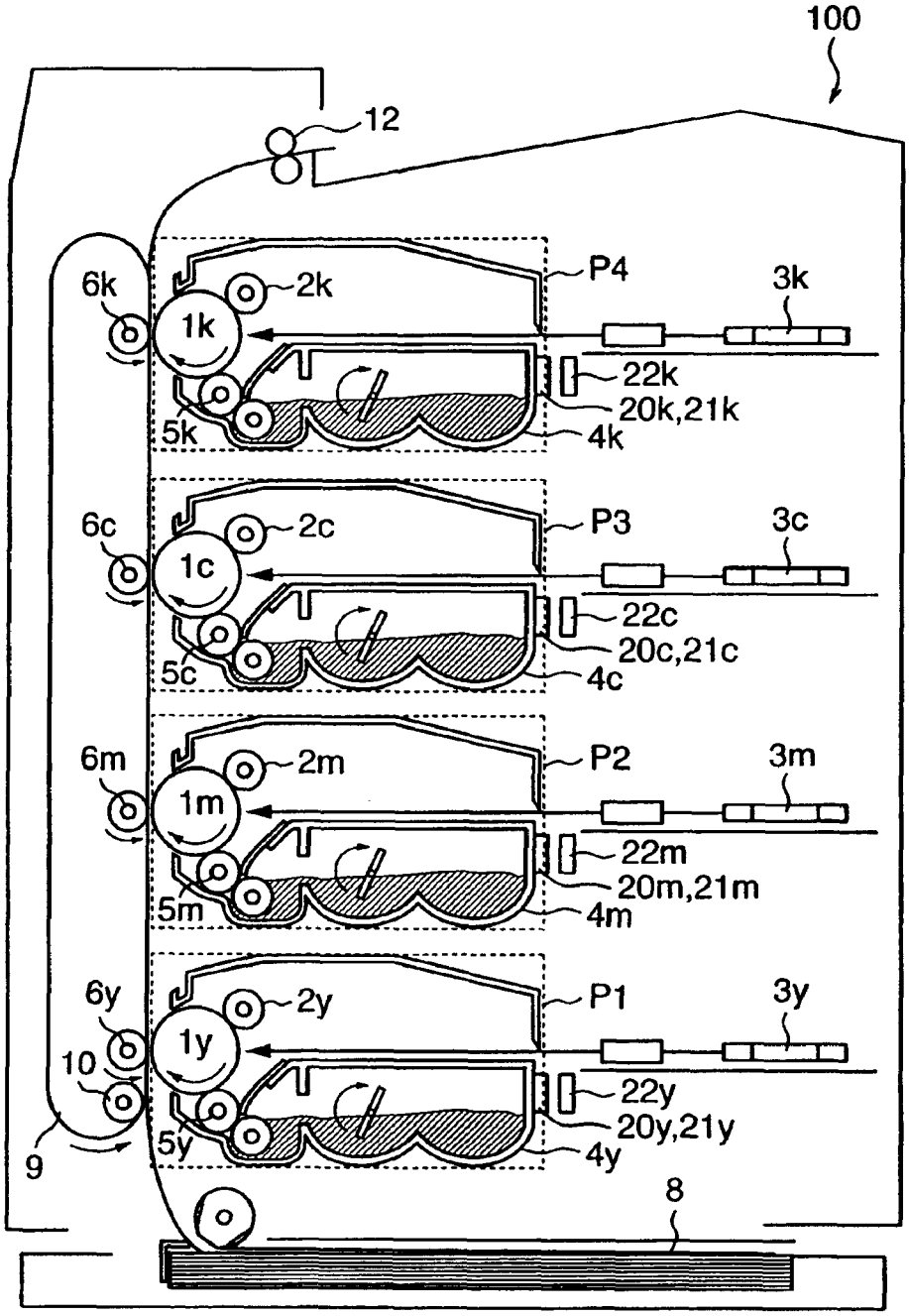
FIG. 1 is a cross-sectional view of a printer according to an embodiment of the present invention.

FIG. 1 is a cross-sectional, schematic view of a color printer according to an embodiment of the present invention. The printer 100 is a tandem-type color laser printer having one developer roller for each color. It should be noted that FIG. 1 is a vertical cross-sectional view along the direction of conveyance of a transfer medium 5.

The printer 100 has as a transfer unit a seamless, tensioned electrostatic transfer belt 9, with process cartridges P1, P2, P3 and P4 for forming different color images aligned vertically along the belt 9. The structure of each of the process cartridges is the same. However, the color of the toner contained in the developer units 4*y*, 4*m*, 4*c* and 4*k* is different.

As shown in the diagram, one of photosensitive drums 1*y*, 1*m*, 1*c* and 1*k* is provided at one end inside each of the process cartridges P1, P2, P3 and P4, with the developer units 4*y*, 4*m*, 4*c* and 4*k* and electrostatic rollers 2*y*, 2*m*, 2*c* and 2*k* provided at the periphery of each of the photosensitive drums 1*y*, 1*m*, 1*c* and 1*k*.

Each of the developer units 4*y*, 4*m*, 4*c* and 4*k* has a container containing either yellow toner, magenta toner, cyan toner or black toner, respectively, as well as a developer roller 5*y*, 5*m*, 5*c* or 5*k*, respectively, for transporting the toner contained in the container.

Transfer rollers 6*y*, 6*m*, 6*c* and 6*k* are provided opposite the photosensitive drums 1*y*, 1*m*, 1*c* and 1*k* on the reverse side of the transfer belt 9, in such a way as to retain the transfer belt 9, which is strung along an appropriate number of rollers, between the transfer rollers 6*y*, 6*m*, 6*c* and 6*k* and the photosensitive drums 1*y*, 1*m*, 1*c* and 1*k*. A suction roller 10 is further provided on the inside of the transfer belt 9 for electrostatically adhering the recording paper 8 that is the recording medium to the surface of the transfer belt 9.

The process cartridges P1–P4 form, in succession, yellow, magenta, cyan and black toner images at predetermined positions on the recording paper 8 that is stuck to and transported by the transfer belt 9. The timing of the operation of the process cartridges P1–P4 is controlled in such a way that the color images overlap, in a process that is described as follows.

The photosensitive drum 1*y*, which is driven by a drive means not shown in the diagram, has a photosensitive surface layer that is electrostatically charged by an electrostatic bias imparted by the electrostatic roller 2*y*. The electrostatic bias is direct current, so the surface electric potential of the photosensitive drum 1*y* is 600V. An image-forming signal related to the yellow component is projected onto this electrostatically charged surface by the laser scanner to form an electrostatic potential image.

When the rotation of the photosensitive drum 1*y* brings the electrostatic potential image to the developing position, yellow toner from the developer unit (developer roller) 4*y* is applied to the electrostatic potential image to form a visible yellow toner image. The yellow toner image is then further sent to a transfer area by the continued rotation of the photosensitive drum 1*y*.

As the yellow toner image reaches the transfer area, so, too, does the recording paper 8 stuck to the transfer belt 9. The transfer bias applied to the transfer roller 7*y* then transfers the yellow toner image to the recording paper 8. Any residual toner remaining on the image carrier 1 without being transferred is returned by the electrostatic roller 2*y* to a polarity that enables the developer unit to recover the toner. By the time the developer unit does recover this excess toner, the photosensitive drum 1*y* has already moved to the next image forming operation.

The yellow toner image-imprinted recording paper 8 is conveyed to an image-forming part P2 shown in the diagram by the movement of the transfer belt 9. Until the recording paper 8 does reach the image forming part P2, as described above, a laser scanner 3*m* and a developer roller 5*m* form a magenta toner image on the photosensitive drum 1*m*. The magenta toner image is then overlaid atop the yellow toner image on the recording paper 8 by the transfer roller 6*m*. The resulting overlaid toner image-imprinted recording paper 8 is then transported to the image-forming part P3.

Similarly, at image-forming parts P3 and P4, laser scanners 3*c* and 3*k* as well as developer rollers 5*c* and 5*k* form a cyan toner image and a black toner image, respectively, on the surface of the photosensitive drums 1*c* and 1*k*. Transfer rollers 6*c* and 6*k* then transfer the cyan toner image and the black toner image in succession to the recording paper 8, completing the transfer process.

The recording paper 8, which now bears a complete color image, is then sent to a fixing roller 12 where it is heated and pressed to fuse the toner images into a mixed color image that is fixedly adhered to the recording paper 8, whereupon the recording paper 8 is delivered to the exterior of the apparatus.

In the foregoing description, it should be noted that the photosensitive drum 1*y* is an electrically conductive cylinder, with a photosensitive layer provided on the surface of the drum base. The photosensitive layer may, for example, be an organic photo semiconductor, amorphous silicon, or the like. The photosensitive drum 1*y* is rotatably driven by a drive means (not shown in the diagram) so that its surface moves (rotates) in the direction of arrow R1 at a predetermined surface speed (hereinafter referred to as peripheral velocity).

An elastic material covers the outer periphery of the metal core of the electrostatic roller 2*y*, and is disposed so that the surface of the elastic material contacts the surface of the photosensitive drum 1*y*.

The developer unit 4*y* contains the rotating developer roller 5*y*, a developer blade that limits the thickness of the toner carried on the surface of the developer roller 5*y*, and a toner supply roller for placing toner on the developer roller 5*y*.

Either magnetic or non-magnetic toner may be used, which may be either polymerized or pulverized. The toner used in the present embodiment is given a negative electrostatic charge when rubbed. The toner is reduced in thickness by the developer blade as it is rubbed onto the surface of the developer roller 5*y*. An electrical power source (not shown in the diagram) applies a development bias of −400V to the developer roller 5*y*, which causes the toner to adhere to the developed portions on the photosensitive drum 1*y*, with the electrostatic potential image developed as a toner image.

In addition, although not shown in FIG. 1, the printer of the present invention has a display unit for the display of information relating to the amount of residual toner detected. Of course, it is also possible to transmit display information to a display connected via a network so as to display desired information at a remote location, that is, a location not coincident with the location of the image forming apparatus.

Residual material remaining on the surface of the photosensitive drum after toner transfer, such as residual toner, is removed by the process described below.

Toner from the developer unit that is stuck to the photosensitive drum surface during image development is given a negative electrostatic charge. This toner with the negative charge is then recovered to the developer by a electric potential difference (the back-contrast during development) that is the difference between the direct current voltage applied to the developer roller during development at a later stage and a photosensitive drum surface electric potential and then transferred to the recording paper by the electrical field of the recording paper, which has been given a positive electrostatic charge by the transfer roller 4 during transfer.

At this time, there are two types of toner remaining on the photosensitive drum that, for one reason or another, do not get transferred to the recording paper. With one type of residual toner, even though the toner is negatively charged, its electrostatic property has deteriorated and it is no longer affected by the electrical field. The other type of residual toner has been given a positive electrostatic charge by the transfer roller on the photosensitive drum, and so it remains on the photosensitive drum without being transferred to the recording paper (so-called inverted toner).

In other words, the residual material left on the photosensitive drum surface without being transferred to the recording paper 8 has both a negative charge and a positive charge. The negatively charged toner is recovered by the back contrast during development and the positively charged residual toner remaining on the photosensitive drum is temporarily given a negative electrostatic charge by the electrostatic charge roller and returned to the developer unit.

The surface of the developer roller 5*y* is made to contact the surface of the photosensitive drum 1 rotating at a predetermined peripheral velocity and rotated in the forward direction with respect to the drum.

At this time, the photosensitive drum and the developer roller are made to rotate at different peripheral velocities and are further given a nip pressure, so as to recover residual toner to the developer unit. For example, the developer roller may be rotated in the forward direction at a peripheral velocity that is 160 percent of the peripheral velocity of the photosensitive drum. It should be noted that the residual material recovered from the surface of the photosensitive drum by the developer roller is agitated inside the developer unit by an agitating member so as to be mixed with other toner and reused.

However, mixed in with toner that is recovered from the surface of the photosensitive drum is material that should not be recovered to the developer unit. Specifically, such material may be toner from an upstream process cartridge that did not transfer to the recording paper and which has adhered to a downstream photosensitive drum.

Thus, in the example of FIG. 1, yellow toner transferred to the recording paper 8 at the location of the photosensitive drum y1 placed at the furthest upstream position might adhere to the downstream photosensitive drums 1*m*, 1*c* and 1*k*, and be recovered as residual toner to the respective developer units 4*m*, 4*c* and 4*k*. Similarly, the magenta toner might be recovered to the developer units 4*c* and 4*k*, and the cyan toner might be recovered to the developer unit 4*k*.

The recovered residual toner is recovered to the developer units and dispersed throughout the interior of the developer units, but as the cartridge nears the end of its useful working life span (that is, the cartridge use amount becomes large) the increase in off-color toner gradually changes the print color, as shown in Table 1 below. It should be noted that the results of Table 1 are for a cartridge with a nominal working life span of 4,000 sheets when printing an image consisting of 4 percent printing.

TABLE 1

| Number of Sheets | 2000 | | | | 3800 | | | |
|---|---|---|---|---|---|---|---|---|
| Color | Y | M | C | K | Y | M | C | K |
| Off-color toner | 0 | 8 | 10 | 11 | 0 | 30 | 34 | 36 |
| Color check | ○ | ○ | ○ | ○ | ○ | X | X | Δ |

For example, in Table 1, at the 2,000-sheet mark, some 8 grams of yellow (Y) toner from upstream of the magenta (M) is mixed in with the magenta (M) toner, and a color check conducted at this time will reveal no problem. However, a color check at the 3,800-sheet mark, with 30 g of yellow toner mixed in, does show a change in color, indicating that the coloration is deteriorating over the last half of the life span of the cartridge.

Another factor degrading picture quality in addition to such off-color recovered residual toner is the poor-quality inverted toner described above. Such degraded toner as this inverted toner is typically under-charged and difficult to develop. Since the electrical charge on the degraded toner is weak, it is hard to hold at the developer roller and is not recovered to the developer unit but remains largely on the developer roller. As a result, much such toner tends to remain as the cartridge approaches the end of its life span and may congeal to form blotches on the image.

The present embodiment detects the amounts of both such off-color recovered toner and inverted toner amounts, at the same time as it detects the toner residual amount. By determining the remaining life span of the cartridge from the above-described calculated amounts, the above-described deterioration in picture quality can be prevented.

First, the off-color toner amount is detected as follows:

Off-color toner amounts for each of the developer units 4*y*, 4*m*, 4*c* and 4*k* are calculated from the probable amount of toner used in the upstream developer units. However, in a cleaner-less system, even if the amount of toner remaining in the individual cartridges is measured and the amount of toner used by that cartridge is estimated therefrom, if there is a lot of off-color toner present in the toner of that particular cartridge, it may not be possible to determine accurately the correct amount of toner actually used. Accordingly, the present invention counts the pixel data sent to be printed for each color and calculates the toner use amount from the number of pixels. Then, for the upstream process cartridges, the off-color recovered toner amount is estimated from the toner use amount calculated as described above.

The off-color recovered toner amount thus estimated is added to the inverted toner amount to obtain a defective toner amount, which is then compared to a threshold unique to the process cartridge stored in the memories provided in the process cartridges. Also, in addition to the defective toner amount and the total residual toner amount, the memory also contains a relational table (relational formula) relating the individual color toner use amounts and the off-color recovered toner amounts, as well as a relational table (relational formula) relating the number of developer roller rotations to the inverted toner amount.

It should be noted that these relational tables (relational formulas), as shown in Table 1 described above, are deduced from data obtained by confirmed test results of off-color toner amounts generated during actual printing, as well as from actual test results on the correlation between the total number of developer roller rotations and the amount of inverted toner generated.

It should be noted that although in the present embodiment these formulas are stored in the memories provided in the process cartridges, in actuality these formulas may be stored in the apparatus controller ROM or non-volatile RAM instead.

Figure 2:
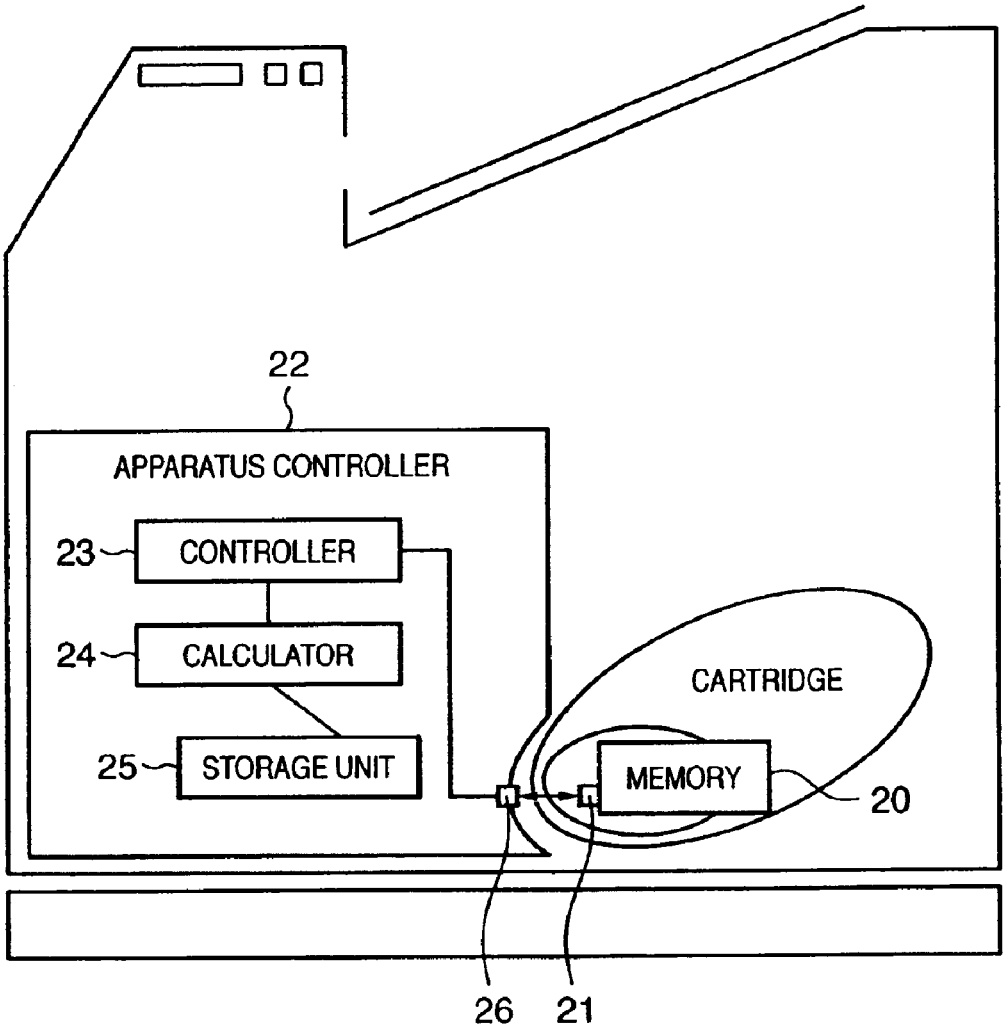
FIG. 2 is a diagram showing the relation between a process cartridge accessory memory and the printer controller in the printer according to an embodiment of the present invention.

FIG. 2 is a diagram showing the relation between a process cartridge accessory memory and the printer controller in the printer according to an embodiment of the present invention.

As shown in the diagram, the process cartridge side is provided with a memory 20 and a memory propagation unit 21, and the apparatus side is provided with an apparatus controller 22, which in turn has a controller 23, a calculator 24, a computational equation storage unit 25 that stores computational equations and the like, and a data communications unit 26.

The memory information is always ready to be transmitted to and from the calculator 24 inside the apparatus controller 22, with the apparatus controller 22 checking the calculated data against the information. It should be noted that the number of developer roller rotations is detected by a developer roller rotation number detector (not shown in the diagram).

For the memory used here, it is possible to use an ordinary semiconductor as an electronic memory without any special restrictions. For example, non-volatile memory, non-contact-type non-volatile memory or power supply-equipped volatile memory can be employed. In particular, in the case of a non-contact memory for performing data transfer between the memory and a read/write IC using electromagnetic waves, since the memory propagation unit 21 and the apparatus controller 22 do not need to be in physical contact with each other the possibility of a malfunction due to poor contact because the cartridge has not been loaded properly is eliminated, making for highly reliable control. As for the memory 20 capacity, it should be fully sufficient for storing a plurality of information such as the cartridge use amounts and cartridge characteristic values.

Figure 4:
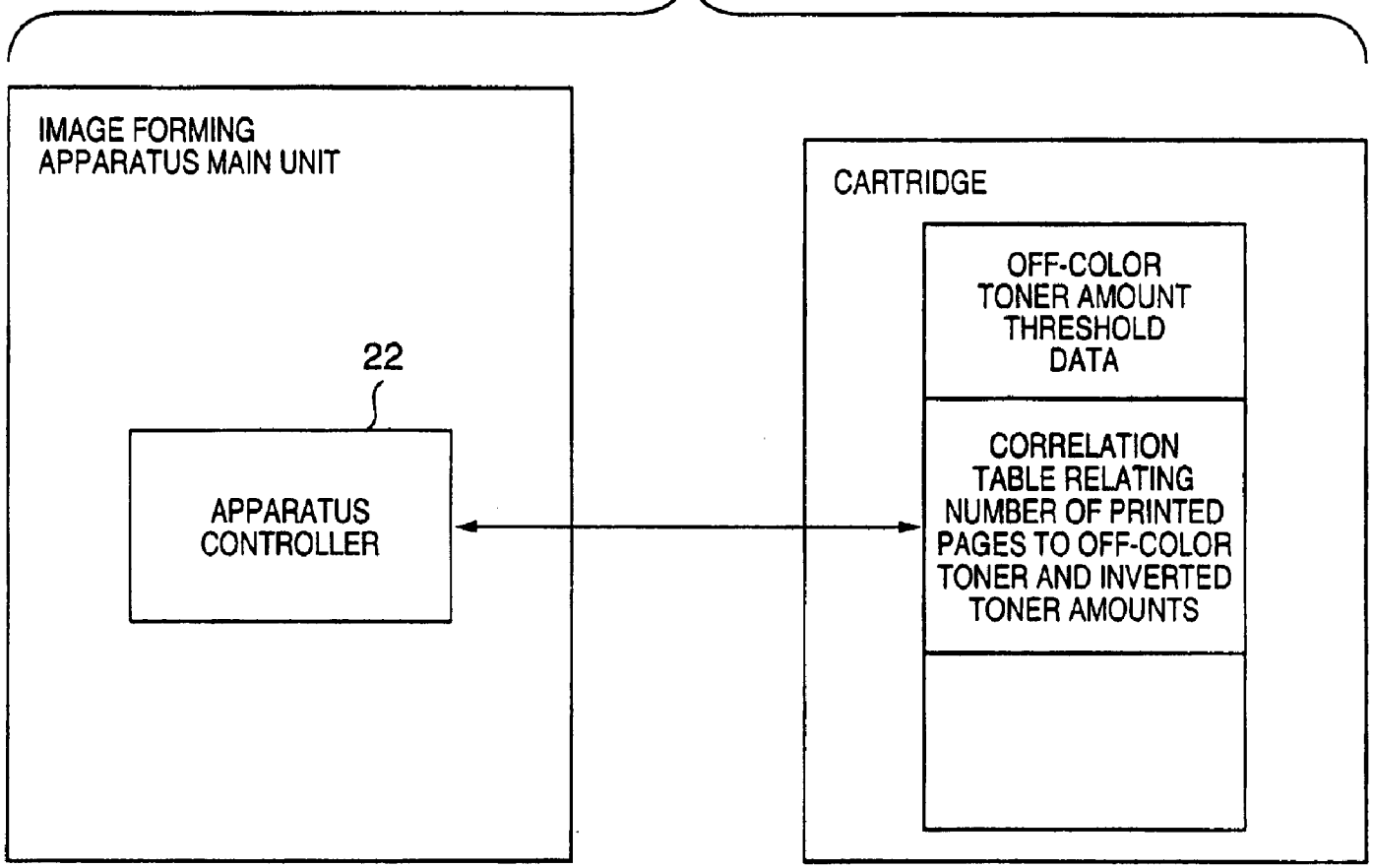
FIG. 4 is a detailed diagram of a cartridge accessory memory according to one embodiment of the present invention.

In addition, FIG. 4 is a detailed diagram of a cartridge accessory memory according to one embodiment of the present invention.

As shown in the diagram, the memory 20 is provided with a storage area for storing threshold data for a defective toner amount that is the sum of the estimated off-color recovered toner amount and the inverted toner amount. This threshold data is a value unique to the cartridge and is written into the storage area when the apparatus is shipped from the factory. When the defective toner amount reaches this threshold data the apparatus determines that it is time to replace the cartridge.

Also, in addition to this threshold data, a relational table that correlates the number of printed pages with the off-color toner amount and the inverted toner amount as described above may also provided in the storage area, and, as with the threshold data, written into the storage unit when the apparatus is shipped from the factory, so that the apparatus controller 22 may read the table and use it to determine whether or not it is time to replace the cartridge.

In an embodiment like that described above:

① The process cartridge is equipped with a memory, with cartridge life-span fixed values (threshold values) for each cartridge.

② The apparatus controller counts the number of pixels of each color, calculates the pixel data of the cartridge(s) positioned upstream of that particular cartridge, and estimates the amount of off-color recovered toner.

③ Also, the apparatus controller counts the number of developer roller rotations, computes the developer roller utilization and estimates the amount of inverted toner.

④ From the results of ② and ③, ascertains whether or not the off-color recovered toner amount and inverted toner amount has reached the cartridge life span fixed value (threshold value).

⑤ If the fixed value (threshold value) has been reached, a message indicating that it is time to replace the cartridge for that particular color is displayed on the printer display.

Figure 3:
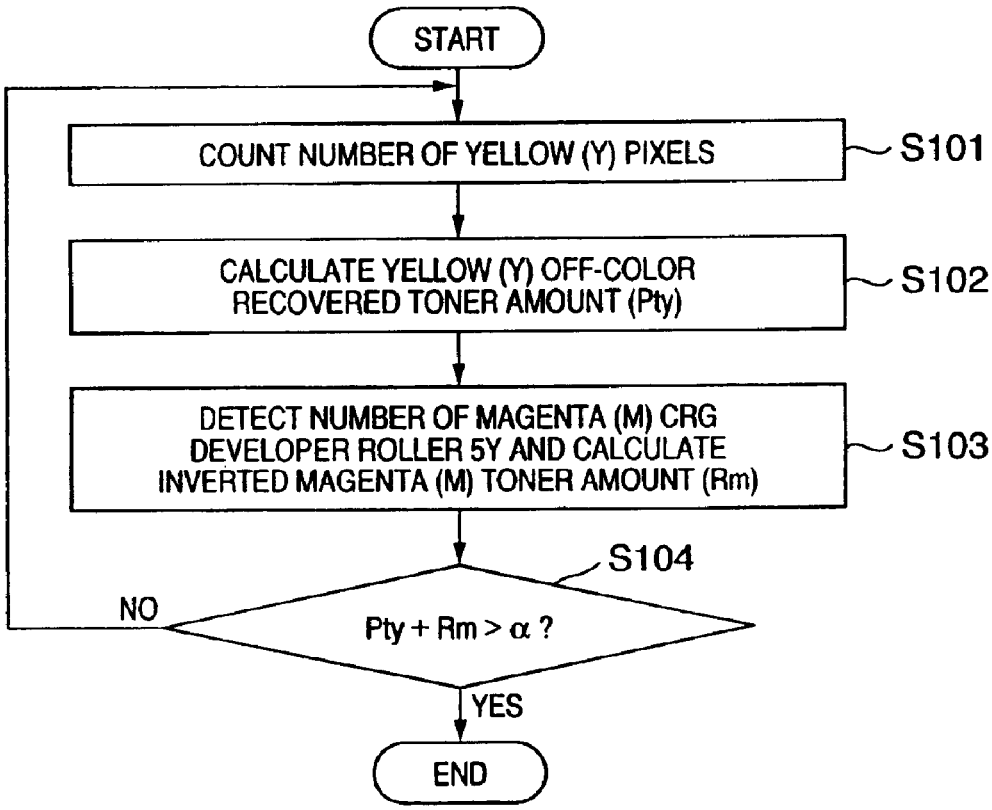
FIG. 3 is a flow chart showing steps in a process of determining whether a process cartridge has reached the end of its life span in the printer according to an embodiment of the present invention.

Using the flow chart of FIG. 3 a description is now given of the operation of determining the useful working life span of the magenta cartridge (M) of the present embodiment.

FIG. 3 is a flow chart showing steps in a process of determining whether a process cartridge has reached the end of its life span in the printer according to an embodiment of the present invention.

Start: Power switch is turned ON and the printer begins operation.

S101: The apparatus controller counts the number of yellow pixels (Py).

S102: The apparatus controller calculates the yellow off-color toner amount (Pty) using the relation formulas in the memory.

S103: The apparatus controller detects the total number of rotations of the developer roller 5*m* and calculates the amount of magenta inverted toner (Rm).

S104: The apparatus controller compares the off-color toner amount integrating steps S102 and S103 with a fixed value α (alpha) previously stored in the memory using equation ① below.

$$Pty+Rm>\alpha(\text{alpha}) \quad ①$$

If the off-color toner amount does not exceed α (alpha), then the result is "NO" and the process returns to step S101. On the other hand, if the off-color toner amount does exceed α (alpha), then the result is "YES", the process proceeds to the end, a message indicating that it is time to replace the cartridge is displayed and the process terminates.

The following shows a concrete example.

① Pty (Off-Color Recovered Toner)

5% of the transferred yellow toner is attached to the magenta photosensitive drum downstream and is recovered to the magenta developer unit. The developer unit's initial toner full weight is 130 g. At this yellow toner developer unit, 100 g is consumed and 30 g remain. On the other hand, 5 g amounting to 5 percent of consumption is mixed into the magenta developer unit. We shall call this 5 percent the recovery rate.

The 100 g consumed at the yellow toner developing unit matches the remaining amount detection system that uses a pixel count Py, such that:

$$\text{consumed toner amount}=Py\times k=100\text{ g}$$

Py=5594920950 pixels (4 percent 4000 sheets). Four percent of the number of pixels in a single A4 sheet is 1398730.237, which corresponds to 25 mg. Therefore $$k=0.025/1398730.237=1.787\times10^{-8}.$$

It should be noted that k is a conversion factor between pixel count and consumed toner amount. The Pty (off-color recovered toner) relational equation is as follows:

$$Pty=Pty(\text{pixel count})\times k(\text{toner amount and pixel conversion value})\times \text{recovery rate}=100\text{ g}\times0.05=5\text{ g}.$$

It should be noted that no discoloration occurs so long as the recovered toner constitutes less than 25 percent of the original developer unit toner amount.

At the magenta developer unit, 80 g of toner is consumed and the amount of magenta remaining is 50 g.

$$5\text{ g}\div50\text{ g}=10\%<25\%$$

Accordingly, discoloration does not occur.

② Rm (Degraded Toner Amount)

The rotation speed of the magenta developer roller at this time is 58000 rpm, with the degradation amount proportional to the rotation speed. The amount of magenta toner remaining is 50 g, and it is known that degradation occurs when the amount remaining in the toner compared to the consumption is large. Thus:

$$Rm(\text{degraded toner amount}) = \text{remaining toner}\div\text{consumed toner}\times\text{developer rotation speed}\times\gamma = 50\text{ g}\div80\text{ g}\times58000\times\gamma=9.26\text{ g}$$

It should be noted that γ is a proportional index to the developer rotation speed, such that $$\gamma=2.55\times10^{-4}$$

③ Calculation of Pty+Rm>α

In addition, the recovered yellow toner amounts to 5 g, so added to the 9.26 g of degraded toner the total amount of defective toner is 14.26 g. Since the threshold value α is 20 g, equation ① is satisfied:

$$Pty+Rm=5+9.26=14.26\text{ g}<20\text{ g}$$

Performing similar calculations for cyan yields the following:

① Pty (Off-Color Recovered Toner)

The amount of magenta toner consumed is 80 g, of which 5 percent has been recovered.

The pixel count Pm=4475936760 (4 percent, 3200 sheets), so:

$$\begin{aligned} Ptm &= Pm(\text{pixel count number})\times k(\text{toner amount and pixel conversion value})\times\text{recoveryrate} \\ &= 4475936760\times1.787\times10^{-8}\times0.05 \\ &= 100\text{ g}\times0.05 \\ &= 4\text{ g} \end{aligned}$$

It should be noted that no discoloration occurs so long as the recovered toner constitutes less than 25 percent of the original developer unit toner amount.

At the cyan developer unit, 74 g of toner is consumed and the amount of cyan remaining is 56 g.

$$4\text{ g}\div56\text{ g}=7.4\%<25\%$$

Accordingly, discoloration does not occur.

② Rc (Degraded Toner Amount)

The rotation speed of the cyan developer roller at this time is 70000 rpm, with the degradation amount proportional to the rotation speed. The amount of cyan toner remaining is 54 g, and it is known that degradation occurs when the amount remaining in the toner compared to the consumption is large. Thus:

$$Rc(\text{degraded toner amount}) = \text{remaining toner}\div\text{consumed toner}\times\text{developer rotation speed}\times\gamma = 54\text{ g}\div76\text{ g}\times70000\times\gamma=12.7\text{ g}$$

③ Calculation of Ptm+Rc>α

In addition, the recovered magenta toner amounts to 4 g, so added to the 12.7 g of degraded toner brings the total amount of defective toner to 16.7 g. Since the threshold value α is 20 g, equation ① is satisfied:

$$Pty+Rc=4+12.7=16.7\text{ g}<20\text{ g}$$

Lastly, performing the same calculations for the black toner produces the following:

① Ptc (Off-Color Recovered Toner)

The amount of cyan toner consumed is 76 g, of which 5 percent has been recovered.

The pixel count Pm=4252139922 (4 percent, 3040 sheets), so:

$$Ptc = Pc(\text{pixel count number}) \times k(\text{toner amount and pixel conversion value}) \times \text{recovery rate}$$

$$= 4252139922 \times 1.787 \times 10^{-8} \times 0.05$$

-continued $$= 76\text{ g} \times 0.05$$

$$= 3.8\text{ g}$$

It should be noted that no discoloration occurs so long as the recovered toner constitutes less than 25 percent of the original developer unit toner amount.

$$3.8\text{ g} \div 16.2\text{ g}=23\%<25\%$$

Accordingly, discoloration does not occur.

② Rk (Degraded Toner Amount)

The rotation speed of the black developer roller at this time is 50000 rpm, with the degradation amount proportional to the rotation speed. The amount of black toner remaining is 16.2 g, and it is known that degradation occurs when the amount remaining in the toner compared to the consumption is large. Thus:

$$Rc(\text{degraded toner amount}) = \text{remaining toner} \div \text{consumed toner} \times \text{developer rotation speed} \times \gamma = 16.2\text{ g} \div 113.8\text{ g} \times 50000 \times \gamma = 12.7\text{ g}$$

③ Calculation of Ptc+Rk>α

In addition, the recovered cyan toner amounts to 3.8 g, so added to the 1.8 g of degraded toner brings the total amount of defective toner to 5.6 g. Since the threshold value α is 20 g, equation ① is satisfied:

$$Ptc+Rk=3.8+1.8=5.6\text{ g}<20\text{ g}$$

A relational table (relational formula) relating the individual color toner use amounts and the off-color recovered toner amounts, obtained from the results described above, as well as a relational table (relational formula) relating number of developer roller rotations to inverted toner amount, also obtained from the results described above, are shown in FIG. 5.

The results of a cartridge life span control such as that described above are given in Table 2 below.

TABLE 2

| | Control (C) or No Control (NC) | | | | | | | |
|---|---|---|---|---|---|---|---|---|
| | No Control | | | | Control | | | |
| | Y | M | C | K | Y | M | C | K |
| Number of developer roller rotations | 80000 | 79000 | 83000 | 50000 | 70000 | 58000 | 70000 | 50000 |
| Number of pages printed | 6000 | 6100 | 6700 | 4000 | 4000 | 3200 | 3040 | 4552 |
| Amount of toner remaining | 0 | 0 | 0 | 0 | 30 | 55 | 60 | 20 |
| Defect due to odd coloration | No defect | Defect | Defect | No defect | No defect | No defect | No defect | No defect |

The results shown above are for a cartridge having a nominal life of 4,000 pages when printing images in which writing, that is, printed characters, makes up 4 percent of the image. Here, the image has been checked for defects due to odd coloration both with and without control such as that described above. Table 2 shows that, without control, the coloration of the magenta (M) and cyan (C) deteriorates if the cartridge is rotated to the end of its life span. It should be noted that the number of developer roller rotations of the color cartridges is greater than the number of developer roller rotations of the black (K) cartridge because the color cartridges are consumed at an image character rate of only 2 percent, compared to the 4 percent described above for black.

However, the control described above indicates the end of the cartridge's life span before toner deterioration and odd coloration begin, so there are no image defects.

As can be understood from the above-described results, the present invention estimates the off-color toner amount from the color cartridge utilization and toner use amount and uses the estimate to determine the life span of the cartridge, thereby making it possible to ensure high quality color imaging.

Of course, the above-described parameters are not necessarily determined only by the number of developer roller rotations but may instead be calculated with reference to the toner type, the cartridge production conditions, and so forth.

In addition, although the present embodiment operates by detecting the number of developer roller rotations, in actuality the number of toner supply roller rotations or the number of developer unit agitator member rotations can be easily substituted for the number of developer roller rotations.

It should be noted that it is also acceptable to contact the developer roller against the surface of the photosensitive drum that rotates at a predetermined peripheral velocity, while rotating the developer roller in the opposite direction of the rotation of the photosensitive drum, at a speed that is 170 percent the speed of the photosensitive drum instead of the 160 percent described above with respect to the preferred embodiment of the present invention. Doing so creates a difference in peripheral velocity between the surface of the photosensitive drum and the surface of the developer roller as well as a nip pressure therebetween, so that, mechanically, any residual toner (including off-color toner) is stopped before the nip and its advance obstructed, thereby enabling the sure recovery of the residual toner to the developer unit.

As described above, the apparatus can thus efficiently eliminate residual toner so as to provide a better image.

With the reverse-direction contact development method, the transfer residual amount increases in order that the residual toner be securely recovered. In such cases, by substituting, into equation (2) shown below, a value $\beta$ that is larger than the $\alpha$ in equation (1) shown above, and, if the equation is satisfied, stopping usage of the cartridge before picture quality deteriorates prevents the formation of poor-quality printed images before they are allowed to happen:

$$Pty+Rm>\beta \quad (2)$$

By so doing, high picture quality can be provided to the user during the life span of the cartridge.

(Other Embodiments)

In the above-described embodiment, the process cartridge is fixed. However, the present invention is not limited to such an arrangement but can also be adapted to a printer in which a plurality of process cartridges rotate so as to form successive toner images on the recording medium, in which case the toner use amount of not the upstream process cartridge but the downstream process cartridge is used.

In addition, in the above-described embodiment the total amount of off-color recovered toner and inverted toner is compared to a threshold. However, the present invention is not limited to such an embodiment but may be adapted so that only the off-color recovered toner is compared to a predetermined threshold in order to determine when it is time to replace the cartridge. Furthermore, the present invention may also be configured so that the proportion of defective toner to total residual toner is compared to a predetermined threshold in order to determine when it is time to replace the cartridge.

Additionally, in the above-described embodiment, the apparatus determines that the life span of the process cartridge is over once it is determined that the process cartridge has deteriorated. However, instead of determining that the life span of the cartridge is at an end, the present invention may be configured to indicate only that there is a risk of deterioration in picture quality once it is determined that the process cartridge has deteriorated.

In addition, as can be appreciated by those of ordinary skill in the art, the present invention may be implemented by either a single device or by a system comprising a plurality of devices.

It should be noted that a software program for implementing the capabilities of the above-described embodiment (that is, a program corresponding to the flow chart shown in FIG. 3), supplied either directly from a recording medium or by using wire or wireless communications, to a system or apparatus having a computer capable of executing such program, the execution of such program by the computer of the system or apparatus achieving equivalent capabilities of the above-described embodiment, is included in the present invention.

Accordingly, a program supplied to and installed in such a computer for the purpose of implementing the functional processes of the present invention itself achieves the present invention. That is, a computer program for implementing the processes performed by the present invention is itself included within the present invention.

In such a case, provided the program capabilities are present, the format of the program, whether executed by object code or by an interpreter, for example, does not matter.

The recording media for supplying the program include, but are not limited to, magnetic recording media such as a floppy disk, a hard disk or magnetic tape, optical or magneto-optical recording media such as MO, CD-ROM, CD-R, CD-RW, DVD-ROM, DVD-R or DVD-RW, or a non-volatile semiconductor memory.

Wire and wireless methods of supplying the program to the system or apparatus described above include, but are not limited to, a computer program that forms the present invention on a server on the computer network, or storing a data file (that is, a program data file) that can become a computer program that forms the present invention on a client computer, such as a compressed file with a self-installing capability, and downloading the program data file to a connected client computer. In this case, the program data file can be divided into a plurality of segment files and the segment files disposed at different servers.

In other words, a server device that downloads to a plurality of users a program data file for implementing the function processes of the present invention by computer is also included within the present invention.

As can be appreciated by those of ordinary skill in the art, the program of the present invention may be encrypted and stored on a recording medium such as a CD-ROM and distributed to users, with decryption data for decrypting the encryption being made available to users who fulfill certain conditions for example by downloading from a home page via the Internet, the users then using the decryption data to execute the encrypted program for installation on a computer.

In addition, as can be appreciated by those of ordinary skill in the art, in addition to implementing the capabilities of the above-described embodiments by reading out and executing the above-described program by computer, the above-described capabilities of the embodiments described above can also be implemented by Operating System (OS) software running on a computer and performing some or all of the actual processes described heretofore based on the program instructions.

Moreover, the present invention also includes an instance in which the above-described capabilities of the embodiments described above are achieved by processes executed in whole or in part by a CPU or the like provided in a function expansion card or a function expansion unit based on program code instructions, after the program code read from the recording medium is written to a memory provided in such a function expansion card inserted into the computer or such a function expansion unit connected to the computer.

The present invention detects deterioration in picture quality due to the presence of defective toner and can prevent the formation of poor-quality images. The present invention is not limited to the above embodiments, and various changes and modifications can be made within the spirit and scope of the present invention. Therefore, to apprise the public of the scope of the present invention, the following claims are made.

What is claimed is:

1. An image forming apparatus comprising:

a detachable first process cartridge configured and positioned to form a first color toner image with a first color toner on a recording medium;

a detachable second process cartridge configured and positioned to form a second color toner image on the recording medium after the formation of the first color toner image on the recording medium;

a first detector configured and positioned to detect the amount of toner used by said first process cartridge during color image formation; and a determination unit configured to estimate the amount of first color toner mixed into said second process cartridge based on the amount of toner detected by said first detector and determining when it is time to replace said second process cartridge based on the estimated amount of first color toner mixed into said second process cartridge.

2. The image forming apparatus of claim 1, further comprising a second detector configured and positioned to detect the amount of toner causing deterioration inside said second process cartridge, wherein said determination unit determines that it is time to replace said second process cartridge whenever a defective toner amount exceeds a predetermined value, the defective toner amount being the sum of the amount of first color toner mixed into said second process cartridge based and the amount of toner causing deterioration inside the second process cartridge.

3. The image forming apparatus according to claim 2, wherein:

said second process cartridge has a memory configured to store one or more parameters relating to the defective toner amount; and said determination unit has a memory configured to store the one or more parameters relating to the defective toner amount stored in said second process cartridge memory, wherein said determination unit reads out the one or more parameters relating to the defective toner amount from said second process cartridge memory to obtain the defective toner amount.

4. The image forming apparatus according to claim 2, wherein said second detector configured to detect the amount of toner causing deterioration inside said second process cartridge detects the toner amount causing deterioration inside said second process cartridge based on utilization of said second process cartridge.

5. The image forming apparatus according to claim 2, wherein said second detector configured to detect the amount of toner causing deterioration inside said second process cartridge detects the toner amount causing deterioration inside said second process cartridge from the rotation speed and length of time of rotation of a development roller included in said second process cartridge.

6. The image forming apparatus according to claim 1, wherein said first detector determines the amount of toner used by said first process cartridge during color image formation from the amount of image data in the image formed by said first process cartridge.

7. A control method for controlling an image forming apparatus having a detachable first process cartridge configured and positioned to form a first color toner image with a first color toner on a recording medium and a detachable second process cartridge configured and positioned to form a second color toner image on the recording medium after the formation of the first color toner image on the recording medium, said control method comprising:

a detection step of detecting the amount of toner used by the first process cartridge during color image formation; and a determining step of estimating the amount of the first color toner mixed into the second process cartridge based on the amount of toner detected in said detection step and determining that it is time to replace the second process cartridge based on the estimated amount of the first color toner mixed into the second process cartridge.

8. A cartridge that can be detachably attached to a color image forming apparatus that forms an image using a plurality of color toners, said cartridge comprising:

a toner container configured to hold toner; and a storage unit configured to store information relating to the amount of unusual toner included in said toner container.

9. The cartridge according to claim 8, wherein the toner container contains toner of a first color, and the unusual toner includes toner of a color different from the first color and/or degraded toner in the toner container.

10. The cartridge according to claim 8, wherein the toner container contains toner of a first color, and the amount of unusual toner is the sum of an amount of toner of a color different from the first color and an amount of degraded toner included in said toner container.

11. The cartridge according to claim 8, wherein said storage unit further comprises a storage area configured to store a table that correlates a print data amount of the image forming apparatus and the unusual toner amount included in said toner container of the image forming apparatus.

12. The cartridge according to claim 8, further comprising a developer member configured and positioned to develop the toner in said toner container onto an image carrier of the image forming apparatus.

13. A memory device loaded into a cartridge used in an image forming apparatus that uses a plurality of color toners to form an image, the image forming apparatus including an image carrier, a toner container holding toner, and a developer member configured and positioned to develop the toner in the toner container onto the image carrier, said memory device comprising a storage area configured to store information related to an amount of unusual toner in the toner container.

14. The memory device according to claim 13, wherein the toner container contains toner of a first color, and the unusual toner includes toner of a color different from the first color and/or degraded toner in the toner container.

15. The memory device according to claim 13, wherein the toner container contains toner of a first color, and the unusual toner amount is the sum of an amount of degraded toner in the toner container and the amount of toner of a color different from the first color.

16. The memory device according to claim 13, further comprising a storage area configured to store a table that correlates a print data amount of the image forming apparatus and the unusual toner amount included in the toner container of the image forming apparatus.

17. The memory device according to claim 13, wherein the cartridge includes at least the toner container.

* * * * *

UNITED STATES PATENT AND TRADEMARK OFFICE

CERTIFICATE OF CORRECTION

PATENT NO. : 6,931,218 B2
DATED : August 16, 2005
INVENTOR(S) : Tomomi Kakeshita et al.

It is certified that error appears in the above-identified patent and that said Letters Patent is hereby corrected as shown below:

Title page,
Item [57], ABSTRACT,
Line 7, "user" should read -- used --.

Column 5,
Line 60, "a" should read -- an --.

Column 15,
Line 31, "based" should be deleted.

Signed and Sealed this

Fourteenth Day of March, 2006

JON W. DUDAS
*Director of the United States Patent and Trademark Office*